US006899563B1

(12) United States Patent
Lee

(10) Patent No.: US 6,899,563 B1
(45) Date of Patent: May 31, 2005

(54) COAXIAL CABLE CONNECTOR

(75) Inventor: Chung-Yu Lee, Taipei Hsien (TW)

(73) Assignee: Edali Industrial Corporation, Taipei Hsien (TW)

( * ) Notice: Subject to any disclaimer, the term of this patent is extended or adjusted under 35 U.S.C. 154(b) by 0 days.

(21) Appl. No.: 10/729,922

(22) Filed: Dec. 9, 2003

(51) Int. Cl.[7] ..... H01R 9/05
(52) U.S. Cl. ..... 439/578; 439/638
(58) Field of Search ..... 439/578–585, 439/638

(56) References Cited

U.S. PATENT DOCUMENTS 5,498,175 A * 3/1996 Yeh et al. ..... 439/578
5,667,409 A * 9/1997 Wong et al. ..... 439/654
5,863,226 A * 1/1999 Lan et al. ..... 439/852
6,113,431 A * 9/2000 Wong ..... 439/638
6,276,970 B1 * 8/2001 Wong ..... 439/638
6,398,593 B1 * 6/2002 Yeh ..... 439/723

* cited by examiner

*Primary Examiner*—Michael C. Zarroli
(74) *Attorney, Agent, or Firm*—Troxell Law Office, PLLC

(57) ABSTRACT

A coaxial cable connector includes a transmission tube having four corresponding elastic strips at each of two ends thereof. The four elastic strips are disposed in the transmission tube in a bent manner, and each elastic strip is formed with a projecting plane and inclined planes. Side edges of the four elastic strips are joined to form a clamping end for inserting and connecting an axis of a coaxial cable therein. According to the aforesaid structure, while curling up a metal plate to form a transmission tube, the four strips extended from two ends are bent in the transmission tube in a consecutive manufacturing process. Projecting planes of the four elastic strips are all capable of coming into contact with the axis of the coaxial cable, thereby enlarging contact areas for increasing signal transmission efficiency as well as preventing terminals from damages.

1 Claim, 6 Drawing Sheets

COAXIAL CABLE CONNECTOR

BACKGROUND OF THE INVENTION (a) Field of the Invention

The invention relates to a coaxial cable connector, and more particularly, to a connector tailored for signal transmission. The connector overcomes shortcoming of a prior art as having numerous parts, and can be fabricated in a consecutive manufacturing process with lowered production costs as well as being protective over terminals to prevent the terminal from damages.

(b) Description of the Prior Art

In current cable signal transmission networks, coaxial cables are necessarily used for signal transmission. Also, due to fast growing demand of network bandwidths, frequencies of signals transmitted by coaxial cables are also approaching high frequencies as technology incessantly advances. However, as frequencies of signals transmitted get higher, quality of connectors for accessing coaxial cables in transmission paths needs to be more and more exact as well. Therefore, even if slight poor contact exists between contact points of connectors, signals being transmitted are likely lost somewhere along the path. Supposed the signals being transmitted contain important data, a user is left with inestimable loss, and even reputations of a responsible industrialist may become ruined.

With reference of FIG. 1, in order to take conveniences for accessing coaxial cables of a user into consideration, a current coaxial connector has a metal sleeve 3, which comes in same specifications. A crucial element that affects transmission quality is a contact element 20 located in the metal sleeve 3. The contact element 20 is a symmetrical metal conducting structure, and has four grooves 22 at tubular sections at two end portions thereof. The four grooves 22 form four contact portions 23 at the tubular sections, with a rear portion of each contact portion 23 provided with an inwardly projecting protrusion 24.

According to the aforesaid structure and referring to FIG. 2, to use the coaxial cable connector, a cable axis 40 is inserted at the contact portions 23 of the contact element 20. For that the protrusions 24 are projecting at the contact portions 23, the cable axis 40 are butted against the protrusions 24 to further stretch the contact portions 23 outward, such that the protrusions 24 are the only physical contact portions between the contact element 20 and the cable axis 40. It is to be noted that contact areas that the coaxial cable connector as for transmission can only account on the contact points between the protrusions 24 and the cable axis 40, and thus the contact areas for transmission are extremely small. To be more specific, possibilities for signal loss are relatively increased, and data in transmission become likely lost to result in perplex of users.

In addition, when inserting the cable axis 40 into an opening of the contact element 20, the cable axis 40 is butted against the protrusions 24 to stretch the contact portions 23 outward, and is clamped by tension of the contact portions 23. Nevertheless, the contact portions 23 are prone to deformations from extensive use and excessive stretched distance by this prior method, and therefore the four contact portions 23 may become incapable of maintaining true circularity thereof and even lose original tension. Once the contact portions 23 lose tension for clamping the cable axis 40, poor contact is resulted for that the protrusions 24 and the cable axis 40 are no longer tightly located next to each other.

Furthermore, for cases that the cable axis 40 being thicker than the opening of the contact element 20, or an inserted end of the cable axis 40 being slightly deviated from the opening when inserting the cable axis 40, the inserted end of the cable axis 40 pushes against edges at ends of the contact portions 23, such that the contact portions 23 are bent and deformed from pushing of the inserted end of the cable axis 40. Thus, the coaxial cable connector becomes damages by failing to insert the cable axis 40 into the contact element 20.

SUMMARY OF THE INVENTION

In the view of the aforesaid shortcomings of the prior art, the primary object of the present invention is to provide a connector tailored for signal transmission, in that the connector overcomes the shortcomings of the prior art having numerous elements by being fabricated using a consecutive manufacturing process. Not only production costs are lowered, but also terminals are protected and prevented from damages.

To accomplish the aforesaid object, the coaxial cable connector according to the invention comprises a transmission tube having four corresponding elastic strips at each of two ends thereof. The four elastic strips are disposed in the transmission tube in a directly bent manner, and each of the four elastic strips is formed with a protruding projecting plane and inclined planes. Side edges at the projecting planes of the four elastic strips are joined with one another to form a clamping end for inserting and connecting an axis of a coaxial cable therein. According to the aforesaid structure, at the same time that a metal plate is curled up to form the transmission tube, the four elastic strips extended from each of the two ends of the metal plate are bent and located in the transmission tube using a consecutive manufacturing process. Projecting planes of the four elastic strips are all capable of coming into contact with the axis of the coaxial cable and clamping the axis therein. Thus, not only contact areas are expanded for substantially increasing signal transmission efficiency, but also terminals are protected and prevented from damages.

DETAILED DESCRIPTION OF THE PREFERRED EMBODIMENTS

The structures, devices and characteristics of the invention shall become more apparent with detailed descriptions of a preferred embodiment and the accompanying drawings below.

Figure 1:
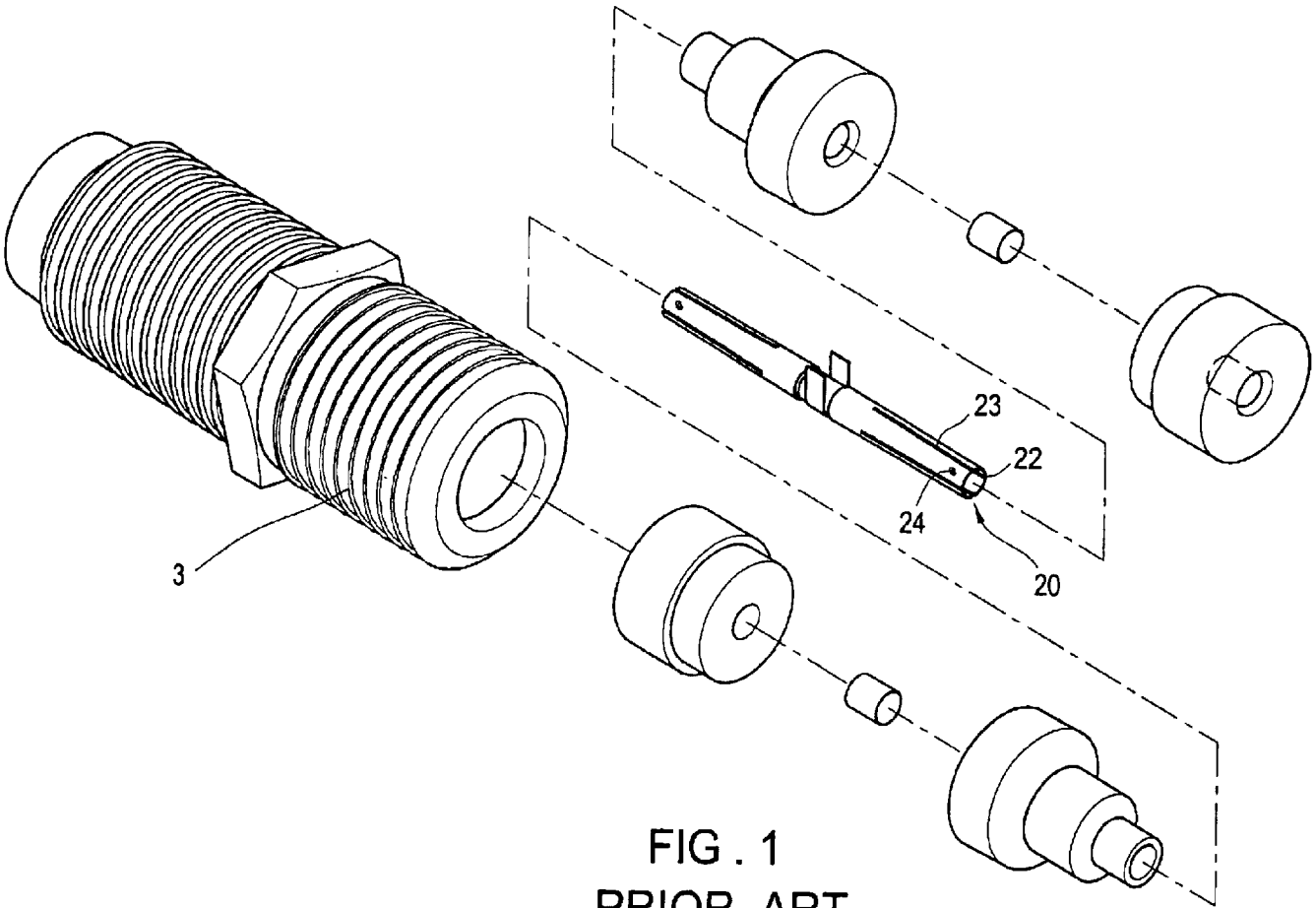
FIG. 1 PRIOR ART
FIG. 1 shows an exploded elevational view of a prior art.
Figure 2:
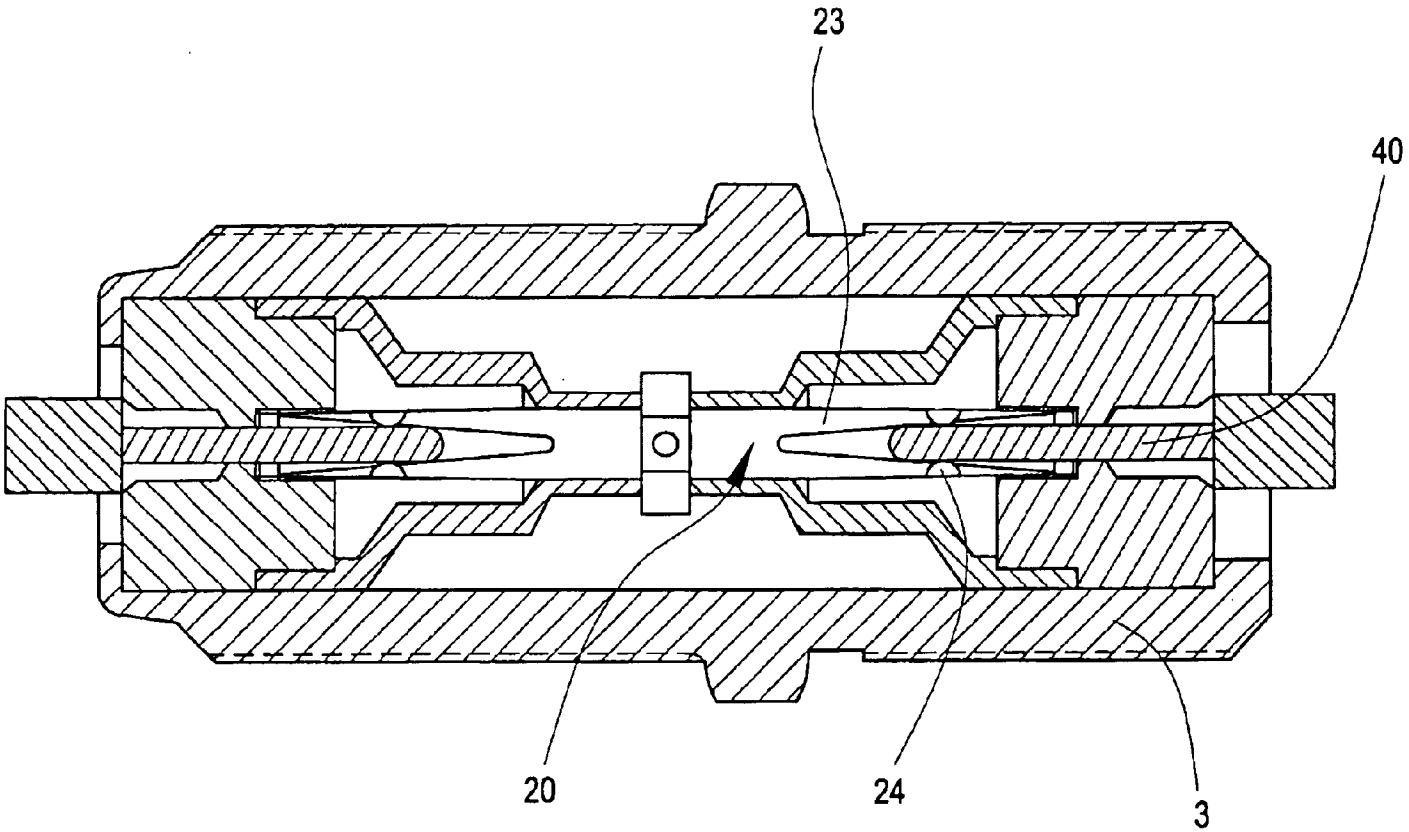
FIG. 2 PRIOR ART
FIG. 2 shows a sectional view of an embodiment of a prior art.
Figure 3:
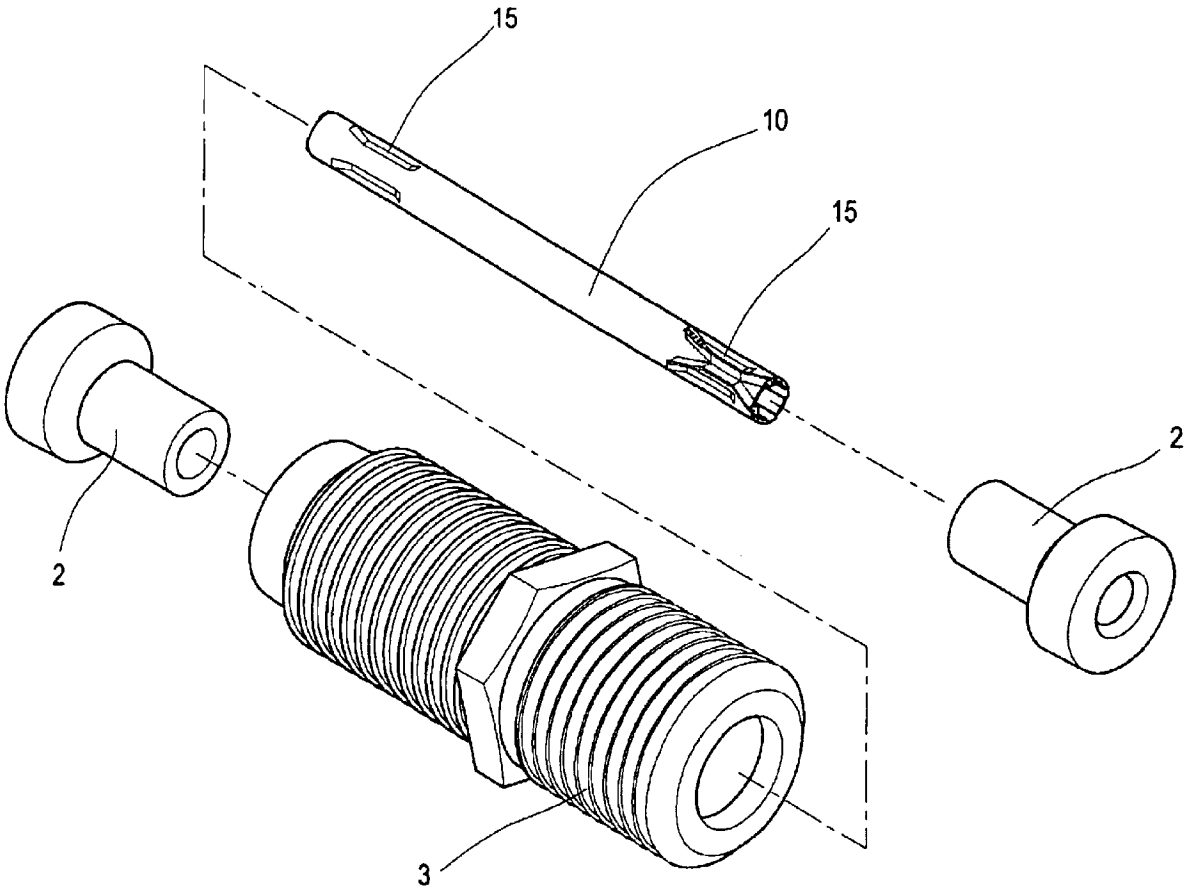
FIG. 3 shows an exploded elevational view according to the invention.
Figure 4:
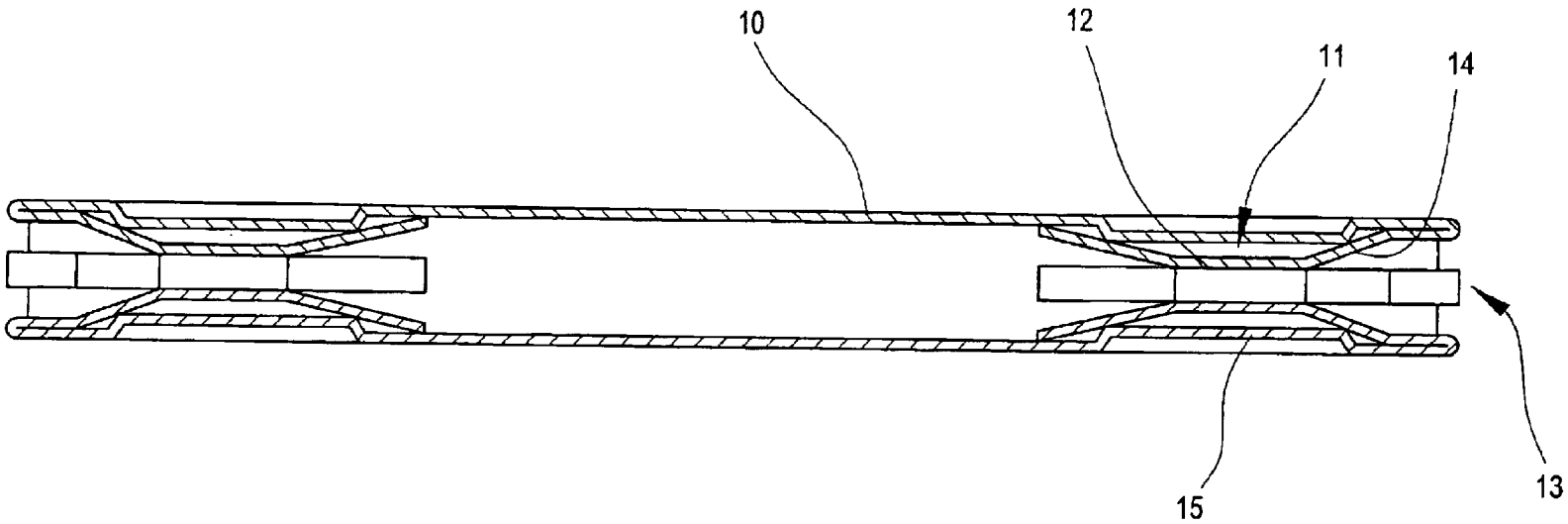
FIG. 4 shows a sectional view illustrating a transmission tube according to the invention.

Referring to FIGS. 3 and 4, a coaxial cable connector according to the invention comprises a transmission tube 10 having an appropriate length and made of a metal material, an inner sleeve 2 accommodated at each of external ends of the transmission tube 10, and a metal sleeve 3 having a screw thread and accommodated around each of the inner sleeves 2.

The invention is characterized that, each end of the transmission tube 10 is formed with four elastic strips 11 having an appropriate width. The four elastic strips 11 are located in the transmission tube 10 in a bent manner, and each has a projecting plane 12 and inclined planes 14. Side edges of the four projecting planes 12 of the four elastic strips 11 are joined with one another for form a long and channel-like clamping end 13. Moreover, the transmission tube 10 has locating grooves 15 at positions of each of the four elastic strips 11.

Figure 5:
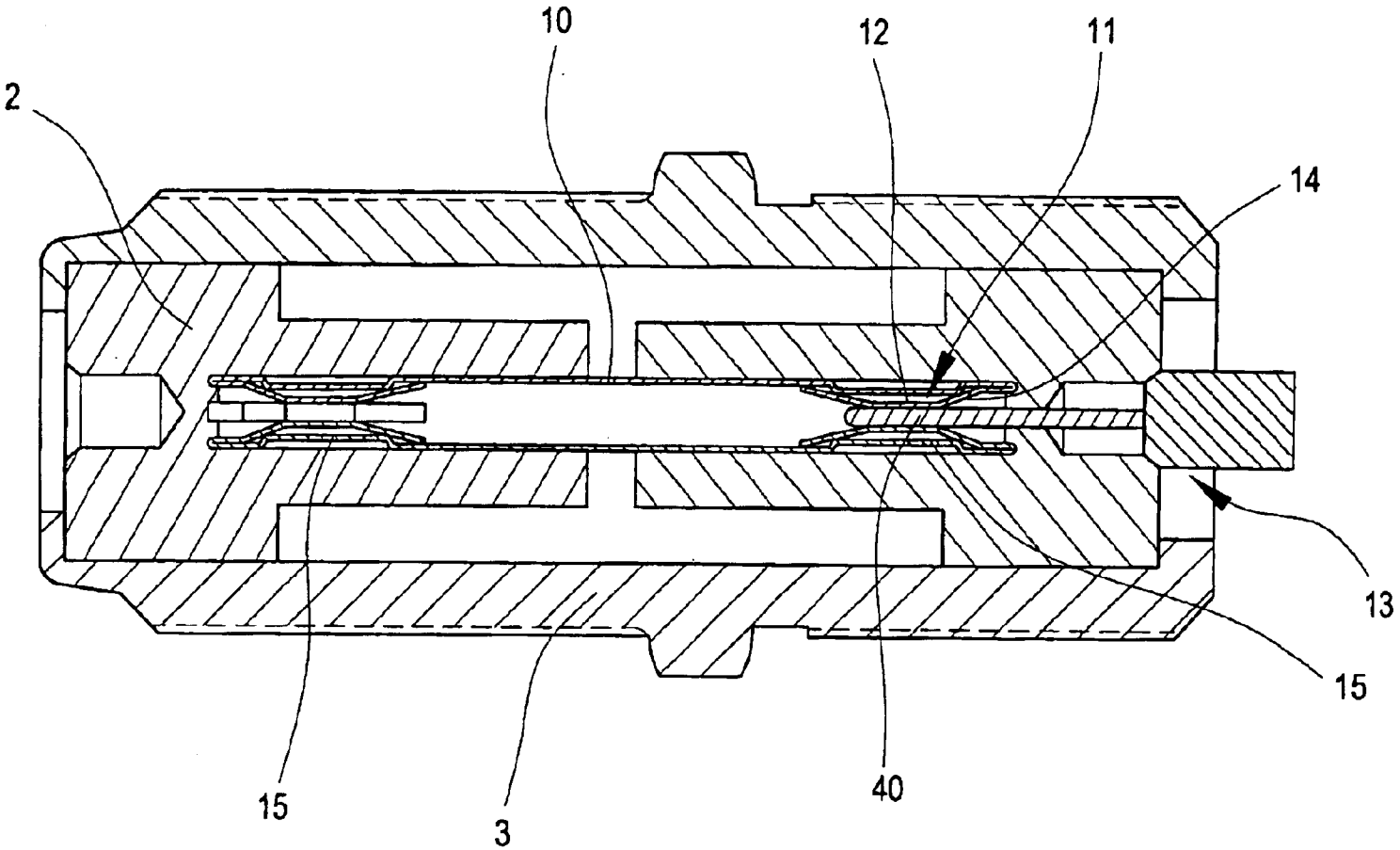
FIG. 5 shows a sectional view illustrating an embodiment according to the invention.

According to the aforesaid structure with reference to FIG. 5, to put the coaxial cable connector to use, a cable axis 40 is inserted from the clamping ends 13 at the two ends of the transmission tube 10. When inserting the cable axis 40, the cable axis 40 comes into contact with the projecting planes 12 to stretch the elastic strips 11 outward. When the cable axis 40 reaches a located position, the projecting planes 12 clamp the cable axis 40 therein using elasticity of the elastic strips 11. Because the four projecting planes 12 form four large-area contact planes at a surface of the cable axis 40, transmission efficiency of signals is substantially elevated with reduced signal loss. Therefore, data being transmitted are allowed with minimal loss to adapt to high-frequency transmission.

Figure 6:
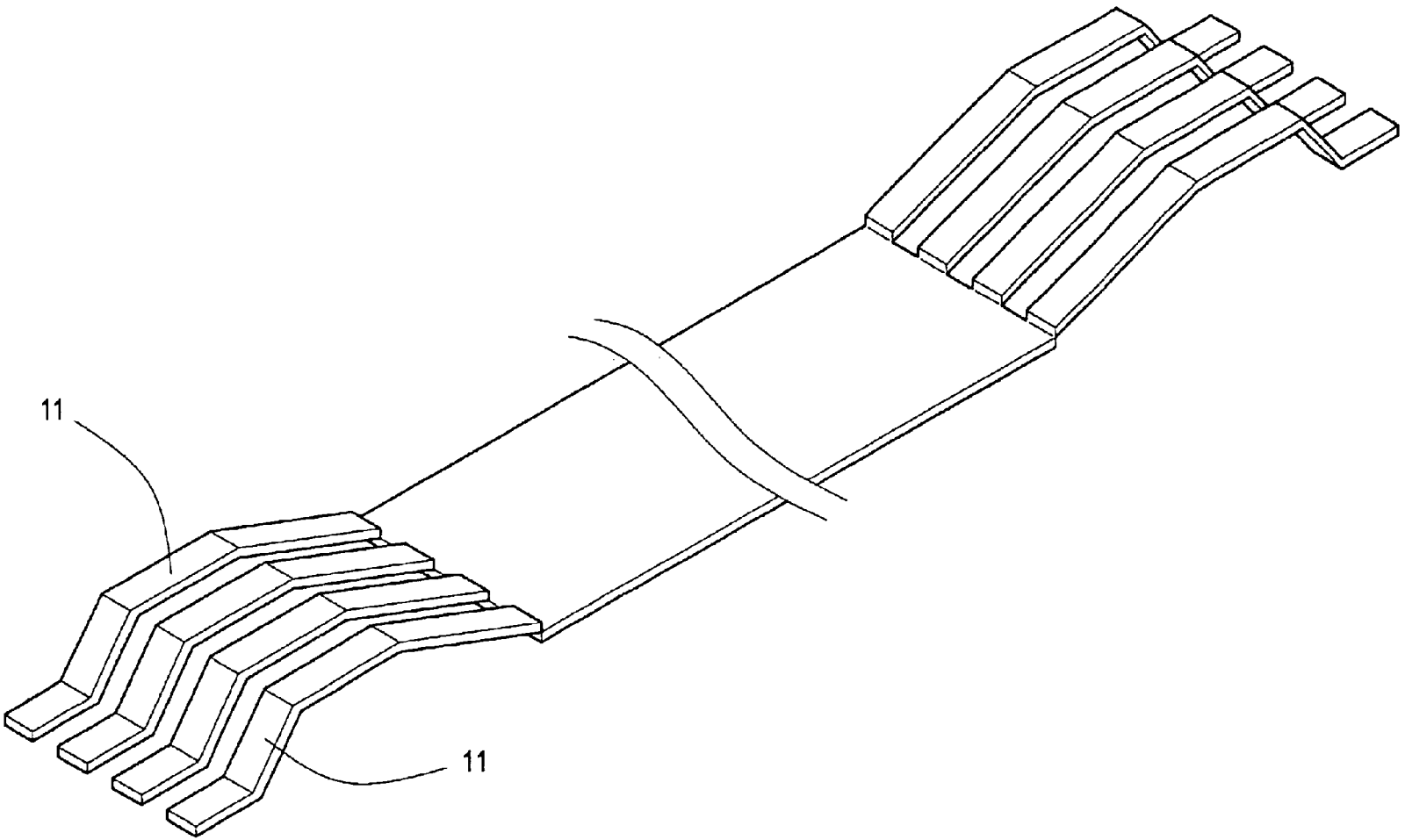
FIG. 6 shows an elevational view illustrating a transmission tube being stretched according to the invention.

Referring to FIG. 6, the structure according to the invention is an integral, and hence a plate body can be manufactured in advance, with two ends of the plate body extruded and stamped to form protruding elastic strips 11, respectively. A middle section of each elastic strip 11 is extruded to form a projecting plane 12 and inclined planes 14, and then bent toward inner sides of the plate body, which is further curled up to form a tube. The structure according to the invention can be completed in a rapid and convenient consecutive manufacturing process with lower production costs.

Also, for that the elastic strips 11 of the coaxial cable connector according to the invention clamp the cable axis 40 using elasticity thereof, only the elastic strips 11 are stretched outward when the cable axis 40 is inserted, while leaving the transmission tube 10 not stretched outward and unaffected. Thus, the transmission tube 10 is prevented from deformation and thereby lengthening lifespan of terminals.

When inserting the cable axis 40 through the clamping ends 13 at the two ends of the transmission tube 10, although an angle of insertion might be slightly deviated, the cable axis 40 is still guided into the clamping ends 13 formed by the four projecting planes 12 via the inclined planes 14. Again, the transmission tube 10 is prevented from pushing of the cable axis 40 and subsequent deformation to protect terminals from damages.

Above all, the locating grooves 15 keep the four elastic strips 11 at fixed positions, so that the elastic strips 11 are also prevented from displacement and deformation from the cable axis 40 rotating in the clamping ends 13.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A coaxial cable connector comprising a transmission tube having an appropriate length and made of a metal material, an inner sleeve accommodated at each of external ends of the transmission tube, and a metal sleeve having a screw thread and accommodated around each of the inner sleeves; and being characterized that, each end of the transmission tube is formed with four elastic strips having an appropriate width; the four elastic strips are located in the transmission tube in a bent manner, and each has a projecting plane and inclined planes; the four elastic strips forming a long and channel-like clamping end; and the transmission tube further has locating grooves aligning with each of the four elastic strips.

* * * * *